US007213489B2

(12) United States Patent
VanDerMeid et al.

(10) Patent No.: US 7,213,489 B2
(45) Date of Patent: May 8, 2007

(54) INK CONTAINER OPENER WITH MULTIPLE INSERTS FOR DIFFERENT CONTAINER TYPES

(75) Inventors: Michael J. VanDerMeid, Livonia, NY (US); Martin Finkle, Rochester, NY (US); Carl William Holland, Webster, NY (US); Patrick D. Carter, North Greece, NY (US)

(73) Assignee: Nu-kote International, Inc., Franklin, TN (US)

( * ) Notice: Subject to any disclaimer, the term of this patent is extended or adjusted under 35 U.S.C. 154(b) by 0 days.

(21) Appl. No.: 10/865,635

(22) Filed: Jun. 10, 2004

(65) Prior Publication Data

US 2005/0274228 A1 Dec. 15, 2005

(51) Int. Cl.
*B67B 7/16* (2006.01)
*B67B 7/00* (2006.01)
*B67B 7/18* (2006.01)

(52) U.S. Cl. ..... 81/3.55; 81/3.25; 81/3.29

(58) Field of Classification Search ..... 81/3.55, 81/3.25, 3.29, 3.31, 3.37, 3.39
See application file for complete search history.

(56) References Cited

U.S. PATENT DOCUMENTS

| | | | | |
|---|---|---|---|---|
| 1,376,994 A | | 5/1921 | Arnold | |
| 1,923,153 A | * | 8/1933 | Lang | 15/432 |
| 2,057,614 A | | 10/1936 | Girard | |
| 2,386,460 A | | 10/1945 | Heim | |
| 2,526,362 A | | 10/1950 | Johnston | |
| 2,554,948 A | | 5/1951 | Kiefer | |
| 2,818,701 A | | 1/1958 | Erkkila | |
| 2,876,665 A | | 3/1959 | Lecours | |
| 3,404,593 A | | 10/1968 | Arcarese et al. | |
| 3,828,976 A | | 8/1974 | Sidelinker | |
| 3,950,801 A | * | 4/1976 | Morrison | 7/152 |
| 3,993,220 A | | 11/1976 | Troy | |
| 4,026,262 A | | 5/1977 | Yasuga | |
| 4,171,055 A | | 10/1979 | Lindgren | |
| 4,171,650 A | * | 10/1979 | Cardinal | 81/3.2 |
| 4,248,564 A | | 2/1981 | Gentile et al. | |
| 4,378,624 A | | 4/1983 | Klingenberg | |
| 4,576,281 A | * | 3/1986 | Kirksey | 206/370 |
| 4,708,033 A | | 11/1987 | Eash | |
| 4,768,271 A | | 9/1988 | Jacob et al. | |
| 4,805,821 A | | 2/1989 | Kowalczyk et al. | |
| 4,817,810 A | | 4/1989 | Shull | |
| D307,701 S | * | 5/1990 | Planchon | D8/40 |

(Continued)

FOREIGN PATENT DOCUMENTS

| | | |
|---|---|---|
| WO | WO 97/47475 | 12/1997 |

OTHER PUBLICATIONS

PCT International Search Report of International Application No. PCT/US05/20573; International filing date- Jun. 10, 2005; 2 pages.

*Primary Examiner*—Joseph J. Hail, III
*Assistant Examiner*—Alvin J. Grant
(74) *Attorney, Agent, or Firm*—Fay Sharpe LLP

(57) ABSTRACT

An ink container opener having a first member having an opening formed therein; and, a second member received within the opening of the first member. The second member further has an opening for receiving an ink container for separating a top portion from a bottom portion of the ink container.

20 Claims, 3 Drawing Sheets

U.S. PATENT DOCUMENTS 5,031,485 A 7/1991 Wu
5,129,566 A 7/1992 Ogden et al.
5,199,470 A 4/1993 Goldman
5,203,236 A * 4/1993 Anderson ..... 81/3.2
5,295,419 A 3/1994 Denning
5,370,019 A * 12/1994 Sartell et al. ..... 81/3.32
5,400,573 A * 3/1995 Crystal et al. ..... 53/468
5,406,320 A * 4/1995 Durst et al. ..... 347/86
5,537,134 A 7/1996 Baldwin et al.
5,546,830 A 8/1996 Yuen
5,551,643 A 9/1996 Chapin
5,657,678 A 8/1997 Cohen
5,704,403 A 1/1998 Schwenk et al.
5,806,397 A * 9/1998 Mendenhall ..... 83/402
5,838,352 A 11/1998 Martinez
5,845,682 A 12/1998 Hayao
5,906,143 A 5/1999 Yuen
5,946,753 A * 9/1999 Roberts et al. ..... 7/156
5,950,296 A * 9/1999 Tatsumi et al. ..... 29/426.5
6,053,604 A 4/2000 Sato et al.
6,089,124 A * 7/2000 Murphy ..... 81/3.39
6,116,724 A 9/2000 Bursese
D437,534 S 2/2001 Gloden
6,182,534 B1 * 2/2001 Hardman ..... 81/3.2
6,286,950 B1 * 9/2001 Altendorf et al. ..... 347/86
6,837,639 B2 * 1/2005 Hui ..... 401/195
6,862,954 B2 * 3/2005 Dubois et al. ..... 81/3.2
6,921,223 B2 * 7/2005 Marschand ..... 401/17

* cited by examiner

INK CONTAINER OPENER WITH MULTIPLE INSERTS FOR DIFFERENT CONTAINER TYPES

The invention relates to an ink container opener. More particularly, it relates to an ink container opener which has multiple adapters to be used to remove caps from several types of ink containers, used in ink jet printing.

BACKGROUND OF THE INVENTION

An ink container typically includes a container body and a container cap. The cap is usually ultrasonically welded, glued or heat staked to the body after the container has been filled with ink during initial manufacturing. Once the ink has been depleted from the container, the container can be reused by refilling it with ink. Refilling ink containers with ink is a two step process. First, access must be provided such as by breaking open and removing the cap from the cartridge. Second, the reservoir must be refilled. To assist in refilling the ink container, and as an alternative to removing the cap, the user usually drills holes through the cap to provide access into the interior of the container so that ink can be added. At times the ink container cap may be fabricated of a rigid plastic material that is difficult to penetrate using a hand-held drill bit which is typically supplied with ink refill kits. Thus, drilling holes into the cap can be difficult for the user, especially for a color ink container where three holes are required.

Accordingly, there is a need for a way to easily remove the cap from an ink supply container to enable the addition of more ink, thereby extending the useful life of the container. Thus, there is a need for an ink container opener that allows the consumer or user to remove the container cap without drilling holes into the cap.

One drawback of prior ink container openers is the lack of a firm grip for the container during a somewhat delicate procedure of separating the top and bottom portions of the container. Furthermore, another drawback of some of the openers is they can be used to only open one type of ink container. While these openers have been effective apparatus for opening containers, there is a need for an improved ink container opener having enhanced gripping and stability features. Furthermore, it is desirable to provide a cap removal tool which can be used with more than one type of ink container.

SUMMARY OF THE INVENTION

The present invention is directed to an ink cartridge opener for removing a cap from the ink supply container to enable the addition of more ink, thereby extending the useful life of the container. More particularly, the present invention includes a container opener which enables the consumer to remove the container cap from different types of ink containers using a multi-piece opener. A variety of different caps can be removed using a single base unit onto which various inserts can be placed. Each of the inserts is intended for use with one of various types of ink containers. Further in this respect, ink containers have caps with different shapes and sizes. By including multiple inserts with various shaped openings that have different configurations to grip a specific cap type, a number of different container designs can have caps removed using a single device.

A user first selects an appropriate insert for a particular ink container. The insert is placed into the base unit and slid into position within an opening of the base unit. A mating interconnection between edges on the insert and grooves in the opening of the base unit secures the insert to the base unit. The weight of the insert assists in holding the insert in place.

The container is then placed into an opening of the insert which positions and holds the cap. Thus, the insert or holder member holds the cap of the container and the second member or base member provides for the container to be supported in cantilever fashion when force is applied to the container body. The user pushes down and exerts force onto an end of the container body spaced from the holder with the palm of his or her hand. This downward force then enables the cap to be disconnected or separated from the body. Thus, the opener enables a consumer to remove a cartridge cap using an opener design which securely holds the cap of the cartridge while the consumer pushes down on the cartridge body with the palm of his or her hand.

In accordance with another aspect of the invention, the base member has a first portion and a second portion approximately perpendicular to each other. The first portion has a substantially U-shaped opening formed with a groove extending along the walls of the opening. The inserts have openings which are substantially rectangular in shape and of different sizes and/or edge profiles for accommodating the caps of the different containers. The opening can, for example, comprise a plurality of ridges extending along at least one side of the opening. The opening can also, for example, be small or large and have linear edges.

One advantage of the invention is that multiple container types can have caps removed using a multiple-insert opener.

Another advantage is the fact that the opener can be used with more than one type of ink container by having several openings for receiving various ink container caps. This results in the opener requiring less storage space than several openers for different size cartridges. The opener also requires less inventory to accommodate different ink container manufacturers.

Another advantage of the present invention is that the user's weight can be used in addition to hand and arm muscles to apply force to the container to open the container. In this respect, the opener can rest on the top of a work surface to absorb the applied force, thereby enabling operation with one hand. Alternatively, a consumer can apply force to the opener on the floor by the ball of a foot.

Another advantage of the invention is achieved by the use of serrated edges along an opening to provide a more secure grip on the container cap.

Yet another advantage is that additional inserts can be provided as new ink containers enter the marketplace.

Still other aspects and advantages of the invention will become apparent to those skilled in the art upon reading and understanding the following detailed description.

BRIEF DESCRIPTION OF THE DRAWINGS

The invention may take form in certain components and structures, a preferred embodiment of which is illustrated in the accompanying drawings wherein.

DETAILED DESCRIPTION OF PREFERRED EMBODIMENTS

Figure 1A:
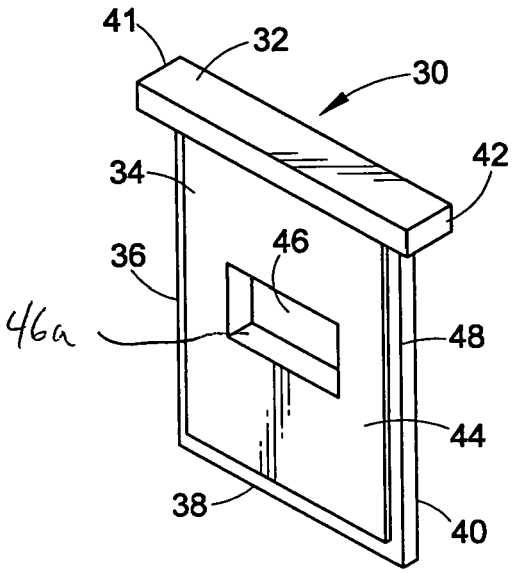
FIGS. 1A–1D are perspective views of an ink container opener, a base unit and several inserts in accordance with a preferred embodiment of the present invention.
Figure 1B:
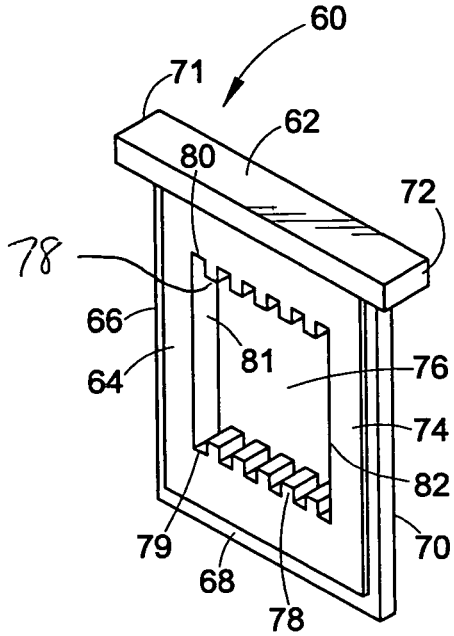
Figure 1C:
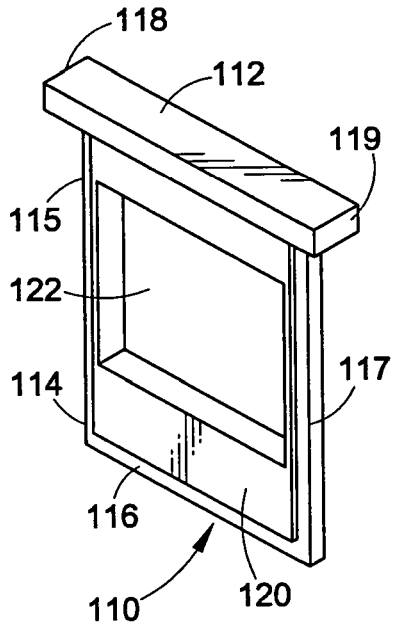
Figure 1D:
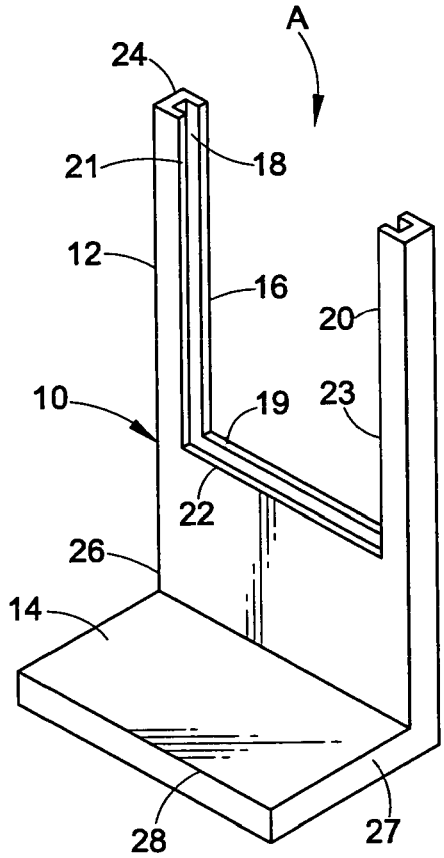
Figure 2A:
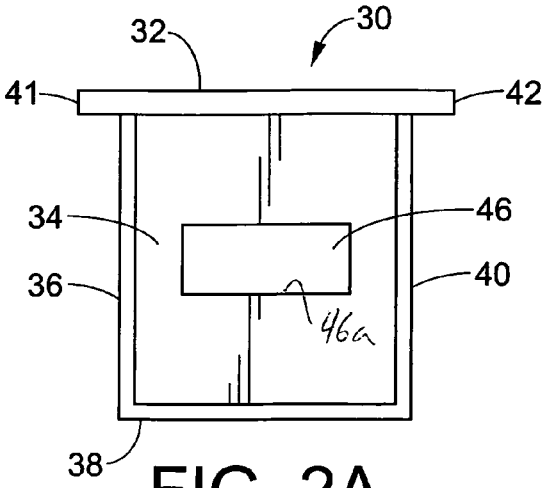
FIGS. 2A–2D are front elevational views of the base and inserts of FIG. 1.
Figure 2B:
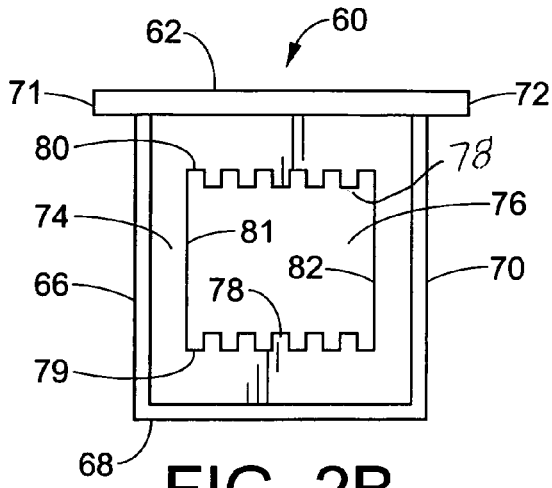
Figure 2C:
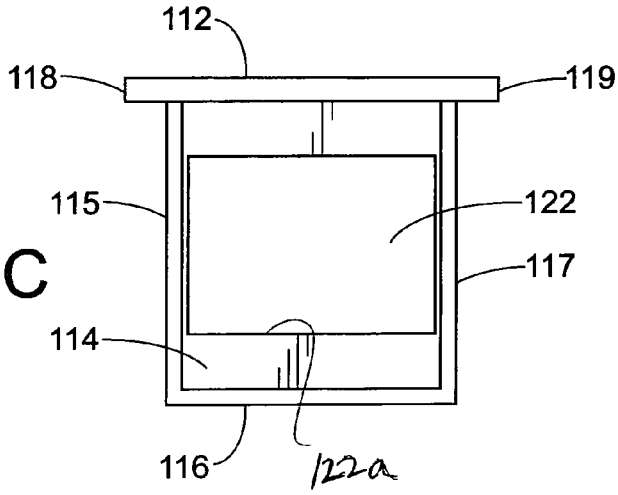
Figure 2D:
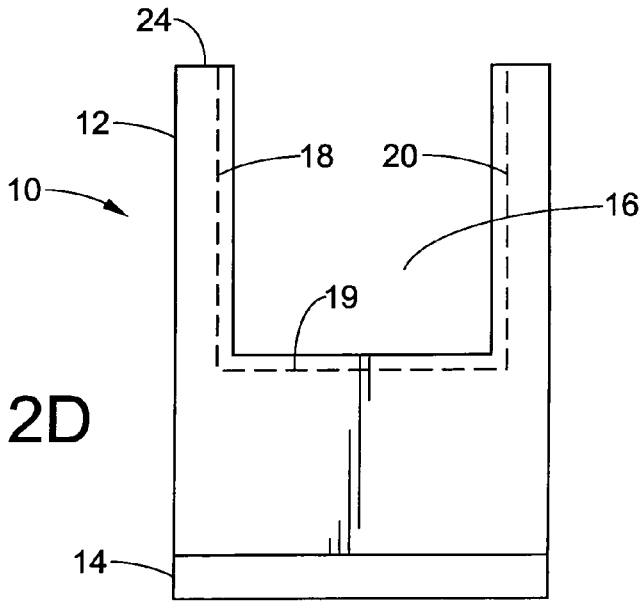

Referring now to the drawings, wherein the showings are for purposes of illustrating preferred embodiments of this invention only and not for purposes of limiting same, FIGS. 1D and 2D show an ink container opener A having a base unit or member 10 with a first member or wall 12 and a second member or wall 14 substantially perpendicular to each other. Each of the walls is substantially rectangular in shape and has flat surfaces. Wall 14 is shown to be shorter along a longitudinal axis than wall 12. However, wall 14 could be of the same length or longer than wall 12 in alternate embodiments. First wall or member 12 has an opening 16 adapted to receive a first portion or a cap of an associated ink container B (see FIG. 3). Opening 16 is shown to be substantially U-shaped in configuration; however, other shapes are also contemplated by the invention. A plurality of substantially C-shaped grooves or channels 18, 19, 20 extend along edges 21, 22, 23 of opening 16.

The first and second walls 12, 14 are formed of a unitary construction from metal, or another suitable material, and are oriented approximately perpendicular to each other to form an L-shaped configuration. Reinforcement members (not shown) can be provided and interposed between the two walls to provide additional strength and rigidity to the opener.

Wall 12 has a first end 24 and a second end 26, and opening 16 extends into wall 12 from the first end, and second wall 14 is positioned adjacent to the second end which is below bottom edge 22 of the opening. Wall 14 has a first end 27 and a second end 28 where the first end 27 is positioned adjacent the second end 26 of wall 12. The dimension of wall 12 is longer between first end 24 and second end 26 than the dimension of wall 14 between first end 27 and second end 28.

Referring to FIGS. 1A–1C and 2A–2C, several types of inserts for the container are shown. Referring to FIGS. 1A and 2A, a first insert 30 has a substantially rectangular top wall or ledge 32. A second wall 34 extends from the ledge and is substantially rectangular in configuration. Wall 34 has edges 36, 38, 40. Wall 32 has edges 41, 42 which extend beyond edges 36, 40 as shown in FIGS. 1A and 2A. Wall 34 has a raised portion 44 which extends beyond the surfaces of edges 36, 38, 40 in a transverse direction as shown in FIG. 1A. Positioned approximately in the center of wall 34 is a rectangular opening or cut-out 46. Opening 46, which has substantially linear edges, is adapted to receive a container cap of the particular rectangular dimension.

During usage, insert 30 is installed into opening 16 of base 10 such that edges 36, 38, 40 are matingly received by channels 18, 19, 20 of the base. The insert is slid into the opening until wall 32 abuts the first end 24 of wall 12. The weight of the insert holds it into place within opening 16.

Referring now to FIG. 1B and FIG. 2B, a second insert 60 which can be used is shown. Insert 60 also has a top wall or ledge 62. A second wall 64 extends from the ledge and is substantially rectangular in configuration. Wall 64 has outer edges 66, 68, 70 and wall 62 has edges 71, 72 which extend beyond edges 66, 70 as shown in FIG. 2B. Wall 64 has a raised portion 74 which extends beyond the surfaces of edges 66, 68, 70 in a transverse direction as shown in FIG. 1B.

A substantially rectangular opening 76 is positioned in the center of wall 64. Opening 76 has a plurality of ridges 78 which extend along edges 79, 80 of the opening. As can be seen clearly in FIG. 2B, the ridges are parallel to each other and are equally spaced apart. The ridges are also shown to be on edges which are opposite one another in the opening. However, ridges could also be provided on opposing edges 81, 82. The ridges are shown to be rectangular bars; however, the ridges could be formed with sharp or serrated edges to provide a grip for engaging the outer surface of an ink cartridge cap member. The insert 60 is used with the base in much of the same manner as described for insert 30. In this respect, edges 66, 68, 70 are slidably received in grooves 18, 19, 20 in the base. A notable difference between the inserts 60 and 30 is that opening 76 has ridges which engage a cap and provide an additional grip to assist in the separation of the cap from a container.

Referring now to FIG. 1C and FIG. 2C, a third type of insert 110 is provided. The insert has a top wall or ledge 112 and a second wall 114 which extends from the ledge and is substantially rectangular in configuration. Wall 114 has edges 115, 116, 117 and wall 112 has edges 118, 119 which extend beyond edges 115, and 117.

Wall 114 has a raised portion which extends beyond the surfaces of edges 115, 116, 117 in a transverse direction as shown in FIG. 1C. A substantially rectangular opening 122 is positioned centrally within wall 114. The opening could also be positioned offset or in other configuration without departing from the scope of the invention.

Opening 122 has linear edges and is configured to be larger than opening 46 in insert 30. The opening extends from edge 115 to edge 117. Insert 110 is also used in much the same manner as the other inserts described with respect to being slidably engaged with the base.

Figure 3:
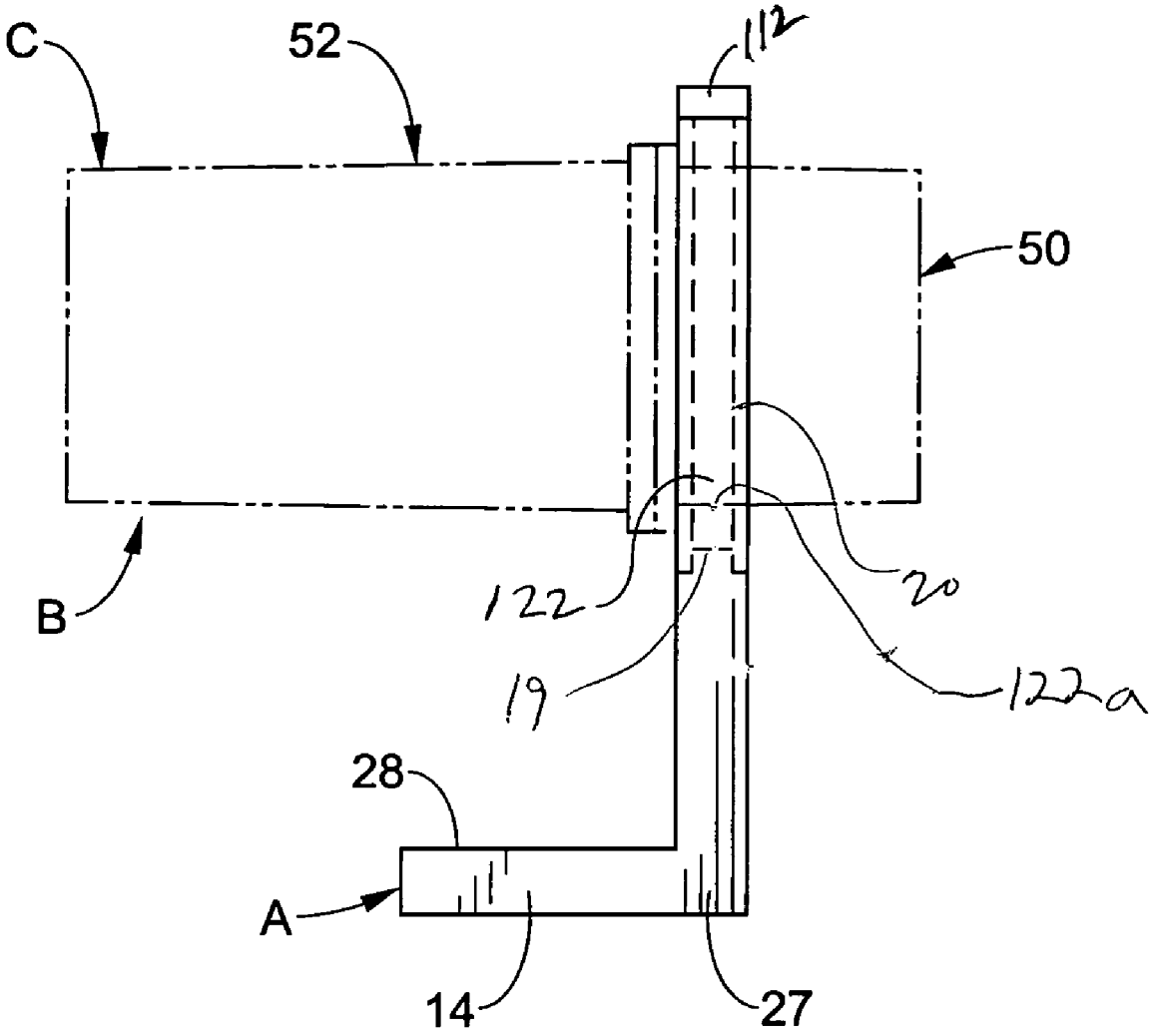
FIG. 3 is a side elevational view of the ink container opener of FIG. 1 showing an ink container installed in the opener in phantom.

Referring now to FIG. 3 and FIGS. 1C and 2C, usage of the opener to separate a cap from an ink container will now be described. An ink container B is positioned within the ink container opener by inserting cap 50 of the container within opening 122. A lip or ridge on the bottom edge of the container cap abuts a peripheral portion 122*a* of the bottom edge of opening 122. As will be appreciated from FIG. 3, the container body is supported in cantilever fashion and a user's hand then applies a downward force C to the ink container thereby engaging the cap with the edges of opening 122 and applying force to a second portion or main body 52 of the container until the cap is disconnected from or separated from the container body. Wall 14 acts as a support member that rests on a support surface such as a table or floor. The ink container is positioned is substantially parallel to wall 14. The support member 14 extends along a longitudinal axis of the container. The user's weight can be used in addition to hand and arm muscles. The opener can be placed on a work surface such as a desk or table to absorb the applied force of the user. This would enable a one-handed application of force to the ink container. Alternatively, for a user with weak hands or arms, or when the cap is too secure to achieve separation by hand, the opener can be placed on a floor surface and the ball or heel of the user's foot can apply the force directly to the ink container body. As seen in FIG. 3, the force to disconnect the cap from a container is applied in a downwardly direction such as by the palm of a user's hand. Alternatively, the force can be applied in a horizontal or other direction based on the orientation of the ink container opener.

The base member first wall is shown to be shorter between first and second ends than the base member second wall; however, other dimensions for the wall can also be used. As previously mentioned, the opener is formed with a substantially L-shaped configuration. The L-shape of the opener allows for space efficiency within a refill kit container. That is, the opener can be placed into a corner of a refill kit container along with a plurality of ink supply bottles and requires only a small increase in the refill kit container volume.

The invention has been described with reference to a preferred embodiment. Obviously, alterations and modifications will occur to others upon a reading and understanding of this specification. The invention is intended to include all such modifications and alterations insofar as they come within the scope of the appended claims or the equivalents thereof.

Having thus described the invention, we claim:

1. An ink container opener comprising:

a first member having a substantially U-shaped opening formed therein, wherein said opening of said first member includes a plurality of channels interconnected to each other;

a second member received within said opening of said first member;

said second member comprising an opening for receiving an ink container, wherein said second member comprises a first wall and a second wall extending from said first wall; and wherein said second wall comprises a raised portion formed inwardly of edges of said second wall.

2. The ink container opener of claim 1, wherein said first member comprises a first portion and a second portion which are substantially perpendicular to each other.

3. The ink container opener of claim 2, wherein a distance from a first end to a second end of said second portion is less than a distance from a first end to a second end of said first portion.

4. The ink container opener of claim 2, wherein said first portion and said second portion are of unitary construction.

5. The ink container opener of claim 2, wherein said opening of said first member is formed in said first portion of said first member.

6. The ink container opener of claim 1, wherein said first wall has opposing edges which extend beyond opposing edges of said second wall.

7. The ink container opener of claim 1, wherein said second wall is substantially rectangular in configuration.

8. The ink container opener of claim 1, wherein said second wall comprises said opening for receiving an ink container.

9. An ink container opener comprising:

a first member having a substantially U-shaped opening formed therein, wherein said opening of said first member includes a plurality of channels interconnected to each other;

a second member received within said opening of said first member;

wherein said second member comprises a first wall and a second wall extending from said first wall;

wherein said second wall comprises an opening for receiving an ink container; and wherein said opening in said second wall is substantially rectangular in configuration.

10. The ink container opener of claim 9, wherein said opening in said second wall is substantially centrally located on said second wall.

11. The ink container opener of claim 9, wherein said opening in said second wall comprises linear edges.

12. The ink container opener of claim 9, wherein said opening in said second wall comprises a plurality of ridges extending along at least one side of said opening in said second wall.

13. The ink container opener of claim 12, wherein said ridges are substantially rectangular in shape and are equally spaced apart from one another.

14. An ink container opener comprising:

a first member having a substantially U-shaped opening formed therein, wherein said opening of said first member includes a plurality of channels interconnected to each other;

a second member received within said opening of said first member; and said second member comprising an opening for receiving an ink container;

wherein said first member of said opener is substantially L-shaped.

15. A method of opening an ink container of the type having first and second connected container portions, said method using an ink container opener having a base member and a holder member; said base member having an opening for receiving said holder member, said holder member having an opening for receiving a first portion of said ink container, said method comprising:

inserting said holder member into said base member opening to be supported by said base member opening;

inserting and supporting said first portion of said container within said opening of said second holder member;

placing said base member on a work surface; and, applying lateral force to the second portion of the container until said container first portion is disconnected from said container second portion.

16. An opener for removing a cap from an ink container body, comprising:

a first member having first and second portions, wherein said first portion comprises a substantially U-shaped opening having a plurality of channels interconnected with each other; and, a second member received by an opening in said first portion, said second member including an opening for receiving a container cap and spacing the container body from second portion.

17. The opener of claim 16, wherein each of said openings is substantially rectangular in shape.

18. The opener of claim 16, wherein at least one of said openings includes ridges substantially rectangular in shape and equally spaced apart from one another.

19. The opener of claim 16, wherein at least one of said openings has a plurality of linear edges.

20. The opener of claim 16, wherein said first portion and said second portion are perpendicular to one another.

* * * * *